United States Patent [19]

Cook et al.

[11] 4,102,240

[45] Jul. 25, 1978

[54] BLASTING SLURRY PUMP TRUCK

[76] Inventors: Merrill A. Cook; Robert B. Clay, both of 2026 Beneficial Life Tower, Salt Lake City, Utah 84111

[21] Appl. No.: 756,242

[22] Filed: Jan. 3, 1977

[51] Int. Cl.[2] ..... C06D 1/08

[52] U.S. Cl. ..... 86/20 C; 102/23; 149/109.6

[58] Field of Search ..... 86/20 C; 102/23; 149/109.6

[56] References Cited

U.S. PATENT DOCUMENTS

| | | | |
|---|---|---|---|
| 3,125,925 | 3/1964 | Jungberg | 86/20 C |
| 3,303,738 | 2/1967 | Clay et al. | 86/20 C |

*Primary Examiner*—Stephen J. Lechert, Jr.
*Attorney, Agent, or Firm*—Thos. A. Wilson

[57] ABSTRACT

The present invention relates to a pump truck for handling aqueous slurry blasting agents. The truck is designed to mix and pump the slurry without the use of augers, electrical drives, hydraulic drives, ingredient flow drive motors or other such equipment, resulting in increased safety and improved function.

21 Claims, 12 Drawing Figures

BLASTING SLURRY PUMP TRUCK

This invention relates to an on-site mixing and borehole loading system commonly called a "pump truck" developed for (but not necessarily limited to) handling the emulsion-type aqueous slurry blasting agents described in co-pending patent application, Ser. No. 726,300, filed Sept. 24, 1976. These slurry blasting agents (or simply "slurries") are formulated and simultaneously pumped into the borehole by rapid mixing in the continuous flow of two hot emulsifiable (or pre-emulsified) liquids (a hot "fuel liquid" and a hot "oxidizer liquid") along with the proper percentage of cold, free-running solid (or solids) to effect sudden cooling by a predetermined amount, together with metered (trace) amounts of liquids for gelling and density control. The cold, free-running solid(s) is (are) porous, prilled ammonium nitrate or AN (and, if desired, a coarse, free-running solid fuel or other oxidizer).

DEFINITIONS

By "hot fuel liquid" is meant a liquid compound, solution, emulsion or suspension having a freezing (or fudge) point in the range 40°-55° C, an oxygen balance (OB) of −6% or less (more negative), and which is nonexplosive by itself in that it will not support a detonation wave for more than about 10 to 15 inches when fired with a 2-inch diameter by 150-gram cast 50/50 pentolite booster when the booster is inserted in one end of the fuel liquid charge contained in a thin-walled plastic or cardboard tube 5 inches in diameter with the fuel liquid at 60°-65° C.

By "hot oxidizer liquid" is meant a (prethickened) aqueous solution of AN alone or in solution with one or more other inoranic oxidizer salt(s) such as sodium nitrate (SN), calcium nitrate (CN), or other inorganic nitrate or perchlorate, the oxidizer liquid having a freezing or fudge point also in the range of 40°-55° C in the same sense as described above for the fuel liquid.

OB is expressed herein as weight percentage excess oxygen (positive OB) or weight percentage deficiency in oxygen (negative OB) to give $CO_2$ and water as products. OB expressed this way is simply $32 \cdot n$ where $n$ is the number of mols of oxygen in excess (positive $n$) or deficient (negative $n$) per 100 grams of the substance in question.

By "slurry blasting agent" is meant an aqueous slurry explosive detonable with a strong booster such as 50/50 pentolite but which will not detonate in a thin-walled plastic or cardboard tube three inches in diameter by eight inches long when initiated with three No. 8 electric blasting caps bundled together, and which contains no ingredient or component (as formulated) which is detonable under the actual conditions of use, using the above 150-gram cast 50/50 pentolite booster test in 5-inch diameter, thin-walled tubes shot in the open air as the criterion for nondetonability.

In the application of the pump truck of this invention, an oxidizer liquid need not contain only a solution of the oxidizer in water but may also contain dissolved, suspended, or emulsified fuels (including thickener[s]) as long as the solution, emulsion, or suspension has an OB of +6% or more and is nonexplosive in the same sense as the fuel liquid. Likewise, a fuel liquid may contain emulsified or suspended oxidizer liquid and yet remain a "fuel liquid" (within the above definition) as long as it has an OB of −6% or less (more negative) and the emulsion or suspension is nonexplosive within the above definition of a nonexplosive fuel liquid.

The principal object of the present invention is a new and improved pump truck for slurry blasting explosives, characterized by increased safety and simplicity of design.

A further object is such a truck which is free from augers, hydraulic or electric drives, ingredient-flow-drive motors and such accessory equipment.

Another object is a truck based on regulated pneumatic and gravity feed arrangements for dry free-flowing solid ingredients to be incorporated with the other slurry ingredients.

In the operation contemplated by the present invention, the pump truck is designed to handle a hot oxidizer liquid, one or two fuel liquids (but usually not more than one at a time), up to about 35% of prilled AN alone or a combination of prilled AN and another free-flowing solid oxidizer or fuel via two separate gravity feeds, together with separate flows of cross-linking (or gelling) and a density-control liquid.

We have found that a superior slurry blasting agent of the copending patent application, Ser. No. 726,300, is produced in the pump truck of this invention by an approximate matching of the freezing or fudge points of the fuel liquid and the oxidizer liquid, and having them both "see" precisely the same carefully predetermined temperature profile during mixing and loading. This desired temperature profile is achieved by (1) carrying the hot fuel liquid and hot oxidizer liquid in the same (well-insulated) tank, in separate compartments divided from each other by metal partitions so that they readily become equilibrated thermally, (2) driving these liquids by air, both at the same carefully regulated pressure, through conduits which are hot-water jacketed at the same temperature, and (3) by premixing all the liquids (including the trace liquids) before they contact the solid(s) as they enter the mixing funnel of the pump truck. By this means the oxidizers and fuel all start solidifying together and in so doing optimize the intimacy of mixing.

Another important advantage of the pump truck of this invention is that the flow lines for all the liquids come out the top instead of the bottom of the tanks of the pump truck. This has an advantage of permitting the mixing and loading unit to fit on the "bed" of any conventional truck of appropriate bed size without modification of the bed as is required for pump trucks of the prior art, the flows in most such units (both solid and liquid) taking place from beneath the tanks and bins requiring building of special beds to contain the complicated pumps, augers, motors, etc., necessary to power the ingredient flows in the pump trucks of prior art. Also, broken lines may be quickly and easily replaced in the present pump truck since they come out the top instead of the bottom of the tank. Moreover, these are usually relatively available flexible tubing even when one takes into regard compatibility requirements. The types of tubing required are generally much less expensive than the conduits (augers, pumping lines, etc.) of the pump trucks of prior art. The jacketing of the hot liquid lines is relatively inexpensive and easily constructed from readily available, low-cost tubing of adequate strength. Pump trucks of the prior art often need jacketing of hot fluid lines, but it is generally impractical to do so by reason of the complicated flow systems involved.

The flow of the hot fuel liquid as well as the hot oxidizer liquid is based on the principle of the "air lift" (see John H. Perry's *Chemical Engineer's Handbook,* 4th Edition, Section 6-13, 1963), Poiseuille's law, and well-known hydrostatics. In the "air lift," compressed air is introduced near the bottom of the vessel, and the pressure gauge on the air line thus reads the pressure at this point. The fluid is lifted from this point near the bottom of the tank to the top of the tank. The effective driving pressure in the fuel liquid and oxidizer liquid lines at the exit of the tank is thus the pressure registered at the air pressure regulator less the hydrostatic head between the inlet of the liquid fuel or oxidizer liquid flow line and the exit of this line out the top of the tank (less, of course, flow friction). Since this hydrostatic head is a constant as also is the flow friction loss, the actual pressure at the point of exit of the tank is a fixed ratio of the pressure registered on the compressed air line. This assures that the actual driving pressure will always be independent of the fluid level in each compartment of the hot liquid tank and directly proportional to the pressure read on the main gauge. Poiseuille's law, on the other hand, states that the flow rate is directly proportional to the applied pressure and the fourth power of the inside diameter of the conduit and inversely proportional to the viscosity of the fluid and the length of the conduit. Thus one may regulate the rate of flow of each of the liquids (1) by applying Poiseuille's law in the selection of the diameter of the tubing, (2) by the applied air pressure, and (3) to some extent by control of the viscosity of the liquid.

In the use of several different liquids in the pump truck of this invention, accurate relative flow is achieved by having all the flows driven at the same pressure using a common regulator valve. (It is not necessary, or even desirable, that the trace liquids be fed from this uniform pressure source because their flows are easily regulated by quickly adjustable flow meters, and one often needs to adjust these flows to meet changing conditions anyway. The use of flow meters for the fuel liquid and oxidizer liquid is economically impractical by reason of the large sizes of the tubing, particularly in the case of the oxidizer liquid). Thus, once the calibrations are set for the proper rates of flow at a given pressure, the flow rates will remain fixed as long as the pressure remains the same. Moreover, if for one reason or another the pressure were to change, the ratio of the flow rates of the fuel liquid and oxidizer liquid would still remain unchanged even though the total flow would, of course, change. The only difficulty one may then encounter is that the relative rates of the solids and liquids flows will change. For this reason it is still essential that the pressure be maintained at a fixed predetermined value with careful control to prevent fluctuations in pressure outside certain required limits. One can, of course, tolerate some variation in the relative rates of flow of the solids and the liquids, but these limits must be well established and adequate controls set up to prevent operation outside them. Such measures include the use of accurate, easily read pressure gauges, accurately controlled air regulators, accurate calibrations, and cut-off devices to stop all flows of components if the relative rates deviate outside prescribed limits.

Fine "tuning" in the calibration of the flow rates in the liquid lines may be achieved by (scaled-for-quick-setting) pinch, ball, or other type of valve control. Operation is perhaps best carried out by providing for quick opening and closing of the flow lines, for example, by a high-pressure (start-stop) pinch-off system.

As far as the free-running solids are concerned, they are simply permitted to flow by gravity directly into the mixing funnel at rates determined by the cross-section of (adjustable-scaled-gate) openings at the bottom of each of the solids bins. These openings, once calibrated, are operated in start-stop control at either one or two settings each (in order to handle either one or else two different slurry compositions as required). The flows of solids need be calibrated only at the beginning of the operation, the free-flow of the solids being aided by vibrating the bins to avoid irregularities in the flow. In the case of free-flowing porous prilled AN, the preferred cooling solid in this invention, the flow rate was found to remain constant within necessary limits of accuracy (independent of the amount of "prills" remaining in the AN bin) as long as the AN level remained above the top of the gate. This should be true also of other spherically-grained solids of a single particle size such as some readily available, SN, CN, urea, paraformaldehyde, and other uniform-grain products. The flow of Alcoa #1622 free-running aluminum (a desirable solid fuel for energy control) fulfilled the requirement of constant flow as long as the level of material in the bin was above the flow orifice, even though it has a wider particle-size distribution than prilled AN.

All of the lines of the pump truck of the present invention are opened and closed in the start-stop operation by push-button control using a pinch-off technique for the liquids and automatic, air-operated pistons for opening the orifices for the solids, all start-stop devices being operated automatically by an air-pressure control system. This system may be constructed so that the start-stop controls may either permit the formulation of but one slurry composition, or, if desired, it may be constructed to mix two slurries, e.g., one slurry composition for a "bottomload" and a second one for a "topload" as is often desired in open-pit blasting. This is accomplished by a system in which flow rates are suddenly changed automatically by suitable distributions of start-stop devices and other means such as a hand operation by the use of a pointer on the handle of a ball valve and a calibrated scaled protractor. The automatic controls may be operated by means of accurate timers which may be present so that an entire borehole may be loaded in one setting, the only functions of the operator being to operate a control to lower the hose into the borehole, preset the timers to produce the desired total amount of each of the two slurries, start the operation by pushing the "on" button, and thereafter simply hand-regulate the rate of pumping (also powered by air pressure) so as to remove the slurry from a holding funnel beneath the mixing funnel in such a way as to avoid pumping air on the one hand or appreciable build-up of slurry above a desired level in the holding funnel on the other. Automatic control systems suitable for application to the pump truck of this invention are well-developed "shelf" items of public domain. However, as far as a slurry pump truck is concerned, the use of automatic air-driven control of the ingredient flow has not previously been described or used on slurry pump trucks. Indeed, the use of air pneumatics in powering all operations of a slurry pump truck is itself novel.

Although the characteristic features of this invention will be particularly pointed out in the claims, the invention itself may be better understood by referring to the description taken in connection with the accompanying drawings forming a part hereof, wherein like reference letters refer to like parts throughout the several views and in which:

Figure 4A:
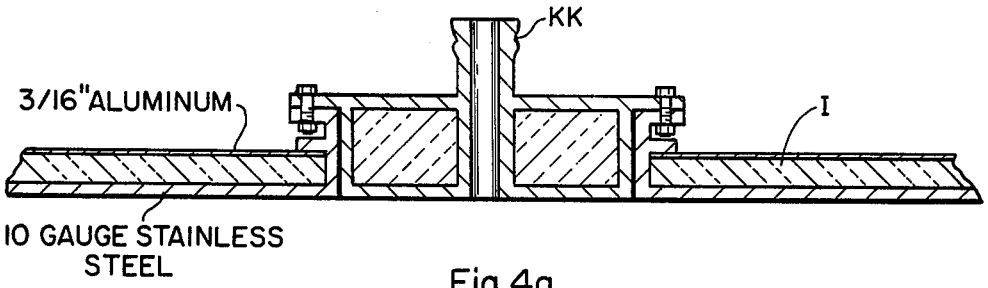

FIGS. 4*a* and *b*, 5*a*, *b* and *c* show details of various fittings used throughout the tank truck assembly.

Figure 6:
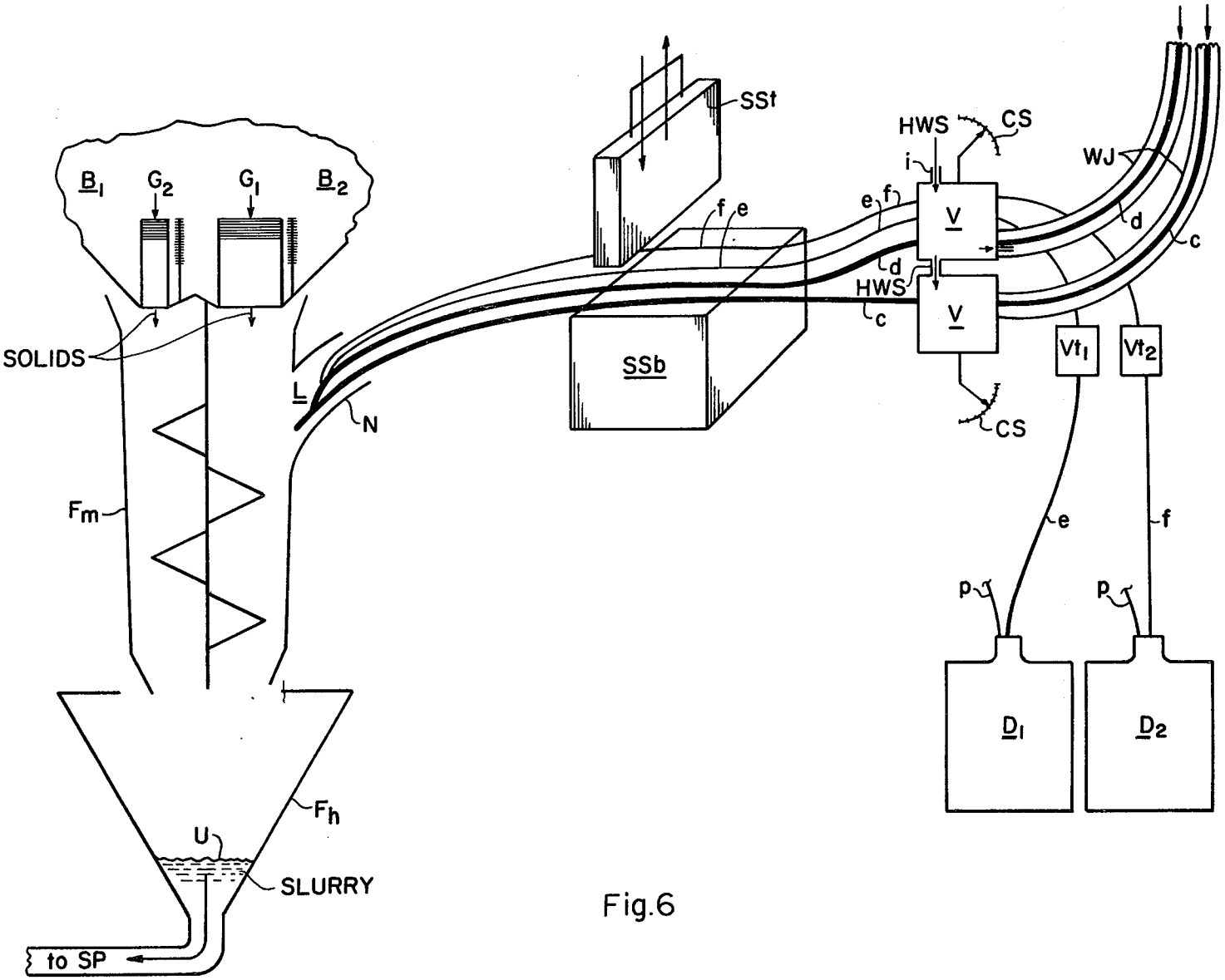

FIG. 6 is an illustration of the design of the connections.

Figure 7:
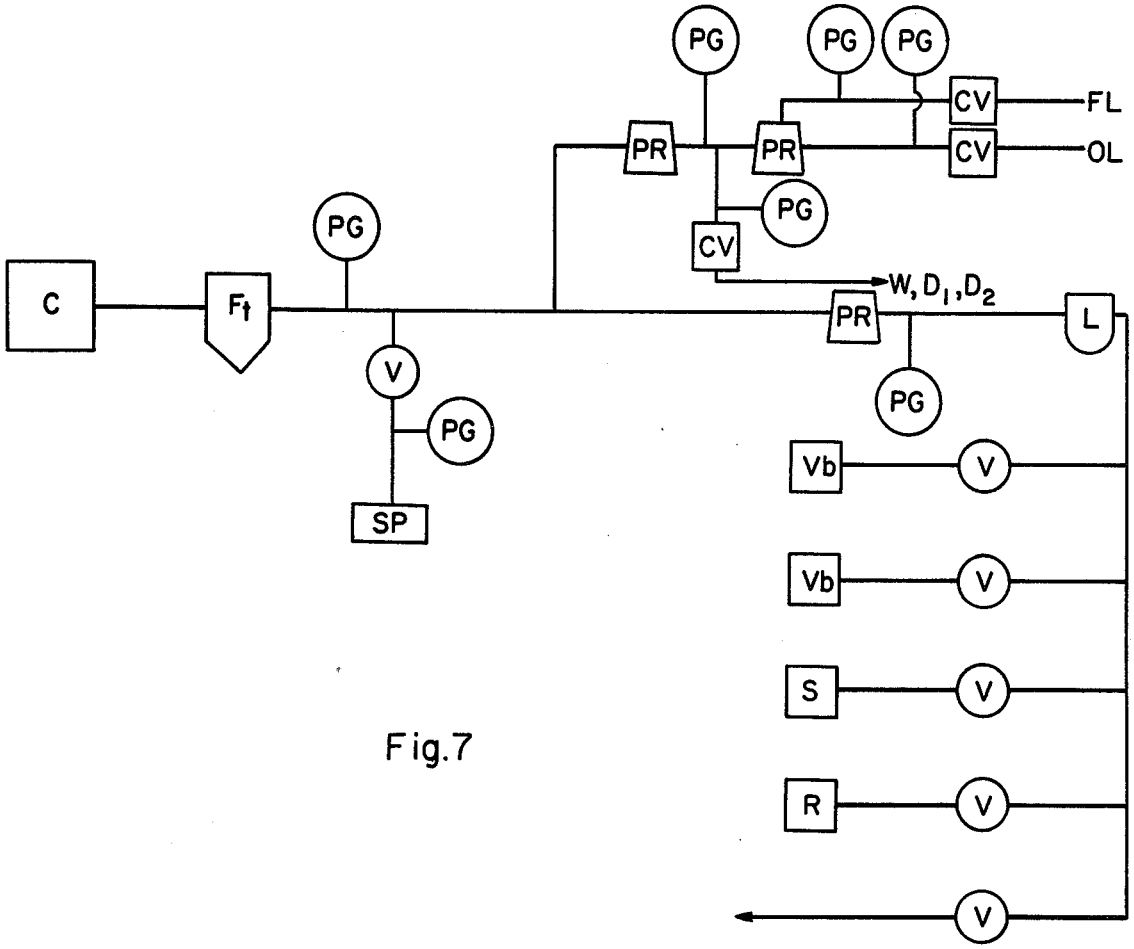

FIG. 7 is a flow diagram of the air system of the invention.

Figure 8:
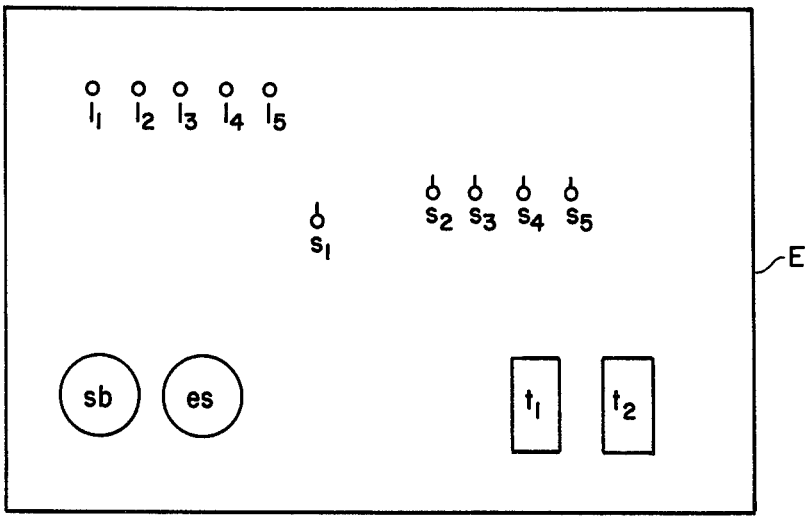

FIG. 8 is a view of the Control Panel.

Figure 9:
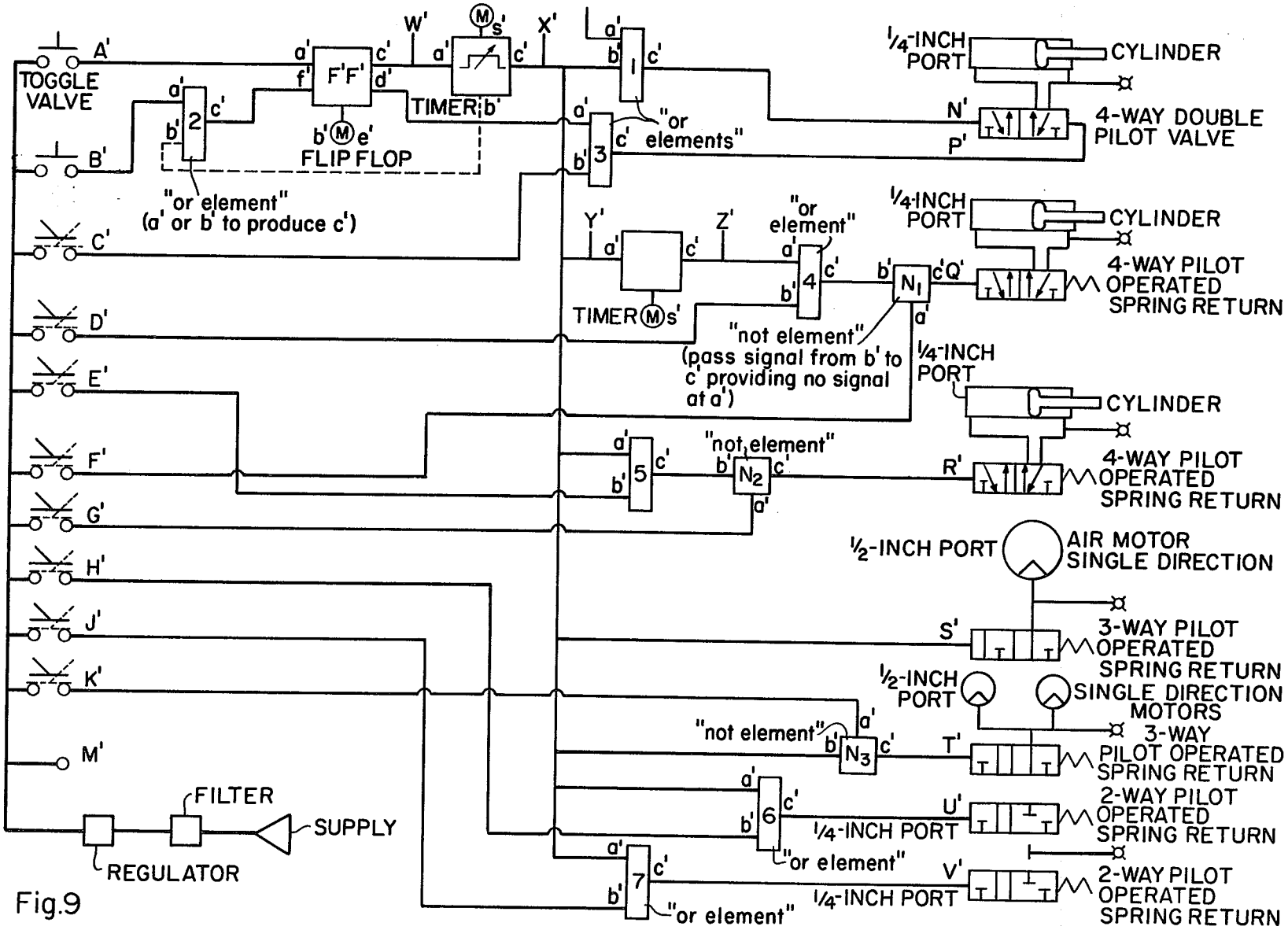

FIG. 9 is a schematic diagram of the automatic controls system.

Having described the pump truck and its operation in general terms, let us now describe specific embodiments of the present invention.

General Layout of Pump Truck

Figure 1:
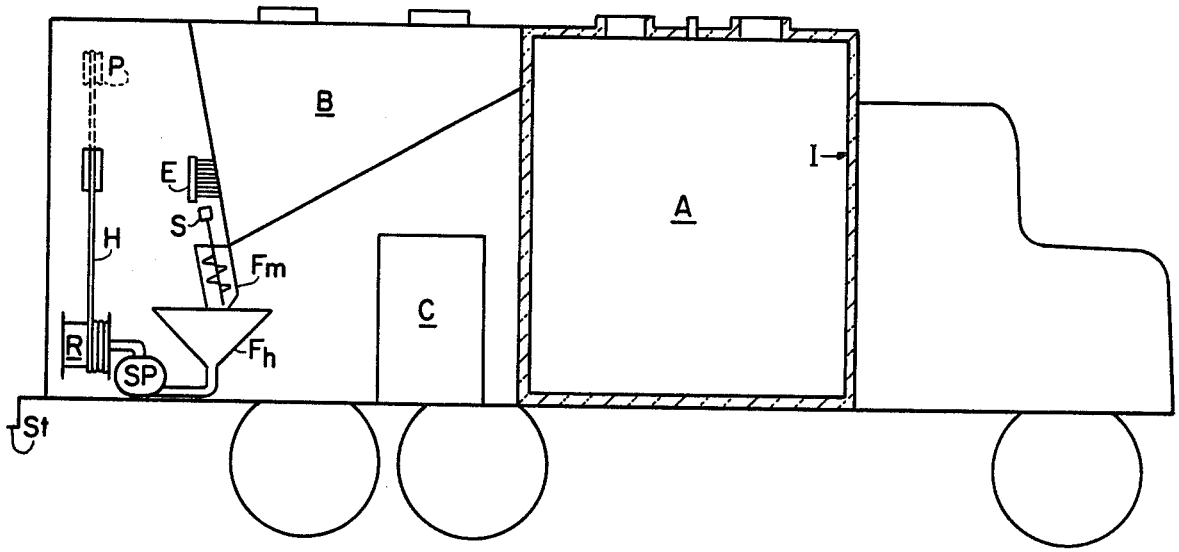
FIG. 1 is a side elevation of the pump truck in schematic form.
Figure 2:
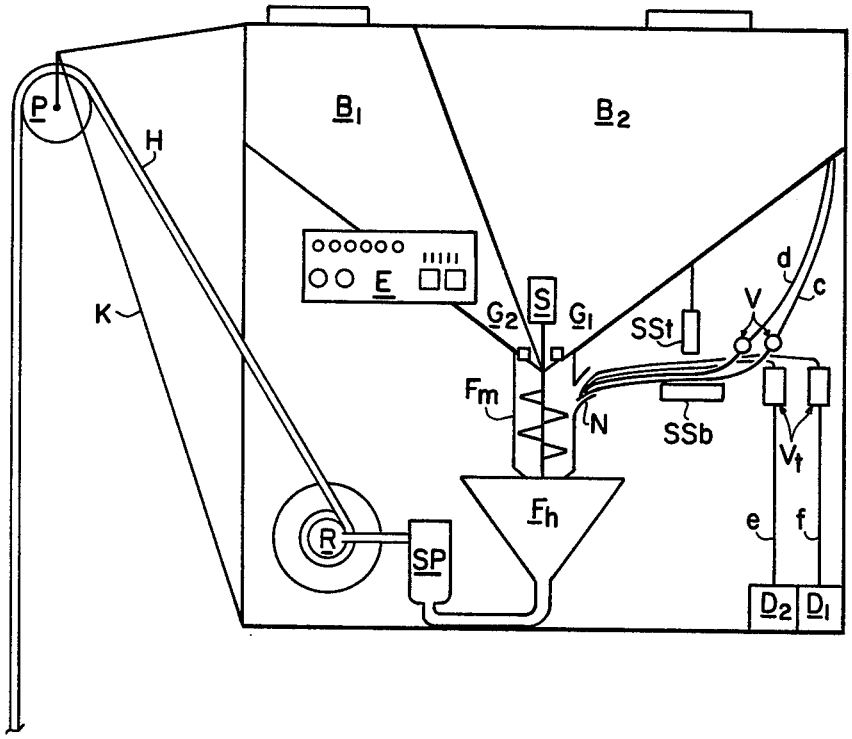
FIG. 2 is a schematic rear view of the truck shown in FIG. 1.

FIG. 1 is a side-on sketch and FIG. 2 is a (rear) end-on sketch illustrating an experimental pump truck built and successfully field tested. (The relative proportions and the partitioning of the different main parts of this system [particularly the partitioning of tank A as described below] need not be considered fixed but instead may be different for each pump truck to fit the requirements of each operation and to maximize efficiency. This system was built for relatively broad flexibility for field evaluations of the system.) A illustrates the insulated (I) hot-liquids tank, B is the solids bin ($B_1$ for prilled AN and $B_2$ for a free-flowing solid fuel, e.g., free-running aluminum), C is a 125 CFM rotary-screw air compressor (other air compressors could be used) $F_m$ is a mixing funnel with an air-driven fast stirrer S provided with air-pressure control, $D_1$ and $D_2$ are the trace liquids tanks which were cubical aluminum containers of about a cubic foot capacity sitting on the floor of the controls cab, SP is the slurry pump (a "Wilden" pump — others could be used), and H is the loading hose operated from reel R. H runs through pulley P held by frame K outside the rear (control) cab after passing through an opening, frame K being hinged so that it can be let out in the position shown for pumping (usually directly over a borehole) but hooked back against the truck when not in use. The automatic control panel E is located at a convenient position for what the operator has to do, namely, lower the hose into the borehole, start the system, watch the flows and hand-regulate the air-driven slurry pump to keep slurry at the proper level in the holding funnel $F_h$, regulate the rate of flow of the trace liquids, and possibly make changes in the settings of the hot liquids flows.

The sections of the flow lines for the liquids inside the controls cab are also illustrated in FIG. 2. Lines *c* and *d* are hot-water jacketed, 2-inch and ¾-inch (inside diameter) oxidizer liquid (OL) and fuel liquid (FL) lines, respectively, which come out the top of tank A, run along the side of bin $B_1$ through a safety wall (not shown) dividing the air compressor compartment from the controls cab, and terminate (as far as hot water jacketing of lines *c* and *d* are concerned) just beyond ball valves V which may be provided with calibrated scale markers. The ball valves V are kept hot by the same hot water circulation that takes place in the jacketed lines *c* and *d*. (No temperature control is needed in the final short sections of the flexible flow lines *c* and *d* between valves V and mixing funnel $F_m$.) Start-stop for all liquid flows *c*, *d*, *e*, and *f* (the latter two being trace liquids from tanks $D_1$ and $D_2$) is accomplished by pinch-off controls. The lower section of this pinch-off (start-stop) unit SS*b* is a fixed block over which pass all four liquid-flow lines. The upper section SS*t* is a piston-driven block shown in an open position. In the closed position it pinches off and stops all four liquid flows simultaneously. The rates of flow of the liquids in the *e* and *f* lines are governed by variable-flow rotometers V*t*. Lines *c*, *d*, *e*, and *f* are not rigidly connected to mixing funnel $F_m$ but are simply inserted into arm N, an approximately three-inch diameter open side arm of funnel $F_m$ tilted slightly upward. Calibration of each liquid flow is easily accomplished simply by closing off all flows (solids and liquids) except the one being calibrated (by switches on control panel E), pulling out of arm N the particular line in question and carrying out the calibration of that particular flow volumetrically, or, in the case of the solids, simply closing all other flows and measuring also volumetrically the rate of flow of the particular solid. The automatic timer, of course, operates normally along with the specific flow being calibrated in each of these calibrations. Gates $G_1$ and $G_2$ control the rates of flow of the solid oxidizer and solid fuel. They may be provided with calibrated scale markers and are calibrated by screw adjustments. They are then operated in automated start-stop via piston-controlled "arms" not shown. Finally, S*t* are steps provided for entrance into the controls cab through a door (not shown).

Hot Liquids Tank and Connections to Hot Liquids Lines

Figure 3:
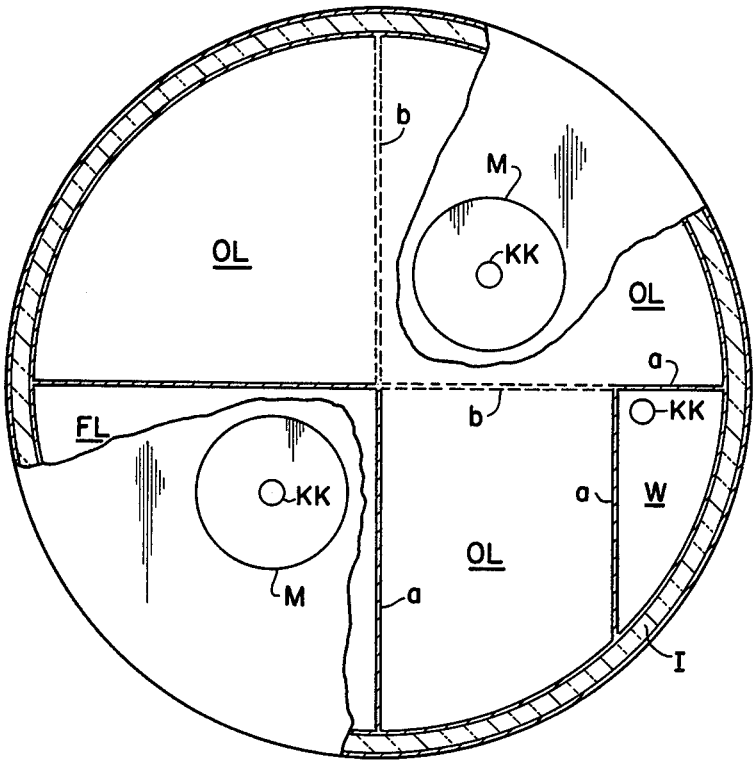
FIG. 3 is a plan view, partially in section, of the insulated storage tank of this invention.

The construction of the (pressurized) hot liquids tank is described by the (top-on) sketch of FIG. 3. There were three compartments in the hot-liquids tank (four may be needed in some embodiments of this invention), each extending the full height of the tank, one for the hot fuel liquid(s) FL comprising in this embodiment one-fourth (less in most cases) of the total capacity of the tank, one for the oxidizer liquid OL comprising all of the rest of the tank except for hot (wash) water tank W. The tank was made of 10-gauge stainless steel insulated in a 3-inch annulus between this stainless steel tank and an outer 3/16-inch-thick aluminum tank by foamed plastic I. The ends were also 10-gauge stainless steel plates with the insulation and outer portion being similar in materials of construction and insulation. The ends were supported by 15 appropriately spaced 7½-foot long by ¾-inch diameter stainless steel rods. The partitions *a* between the compartments were also 10-gauge stainless steel. (These partitions were tested to withstand differential pressures between compartments as high as 30 psi with operating pressures not to exceed 6–8 psi.) The dotted lines *b* represent perforated baffles to minimize the effects of liquid surges in transit. OL and FL compartments were provided with 18-inch diameter manholes M bolted securely (with 20 ¼-inch stainless steel bolts) to the top of the tank, each manhole provided with a 3-inch diameter "Kamlock" KK for quick and easy sealing and opening for loading and unloading of the tanks. The water tank had no manhole but was also provided with a Kamlok. The caps of the Kamloks were each provided with valves (not shown) to bleed off the pressure when necessary.

Figure 4B:
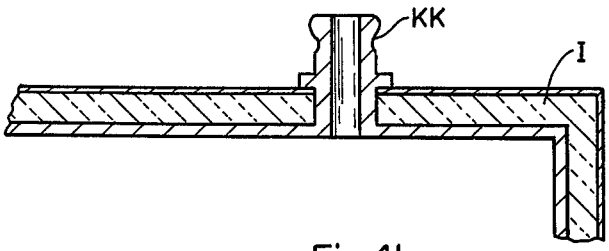

FIG. 4*a* illustrates the construction of the manhole covers M and Kamloks KK (without caps) on top of the OL and FL compartments of the tank. The Kamlok on the water compartment is illustrated in FIG. 4*b*. The Kamlok device is a standardized stainless steel (quick open and close) cap provided with O-rings and lever-clamps on each side to make the system airtight. The manholes M, of course, provide less ready, but still adequate, access to the tank compartments for repairs, preparation of OL and FL if desired, and other reasons as needed.

Figure 5A:
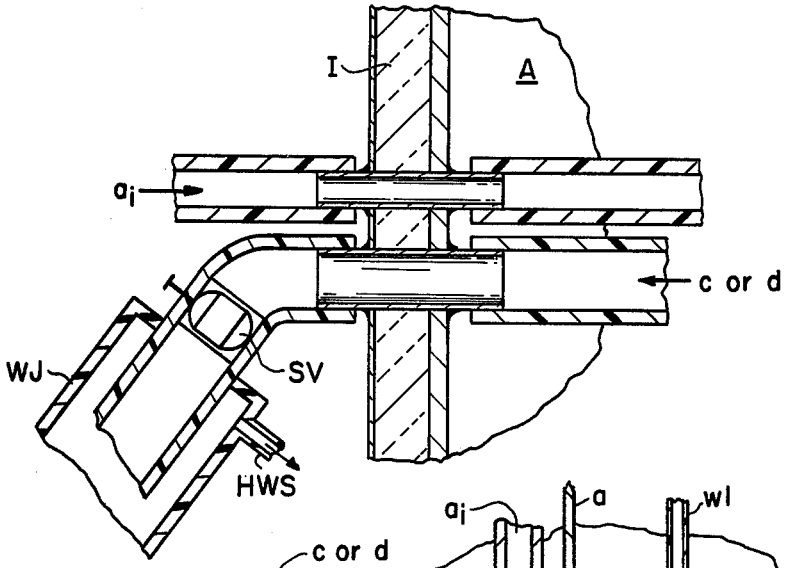

FIG. 5*a* illustrates a short section of the fuel-liquid line *d* (or oxidizer-liquid line *c* which was similar in construction) and an air-inlet line going through the wall near the top of the tank. (Lines *c* and *d* extend continuously from the bottom of tank A to the mixing funnel $F_m$.) These lines were connected inside and out with clamps to a stainless steel pipe welded through the side walls of the tank. Flow lines *c* and *d* were each provided at a position just outside the tank with safety (ball) valve(s) SV to be closed to prevent syphoning of the hot liquids from the tank in case of a rupture on one of the lines *c* or *d* when the level of fluid in the tank is above the point of rupture. These valves are left open in normal operation and closed at other times, particularly when a full pump truck is in transit to the mine. A hot-water jacket WJ was provided for both the *c* and *d* lines all the way from valves SV to (and in) control valves V (FIG. 2). These jacketed lines were made by simply clamping a larger hose with an appropriate outlet over the flow line. The hot water for this temperature control was taken from the thermostatically controlled radiator of the compressor through valve V and into the jacket of the line.

It is important to realize that many types of commercial flexible tubing are incompatible chemically with hot organic liquids (FL) such as those described in the copending patent application, Ser. No. 726,300. Therefore, lines *c* and *d* must be carefully selected for chemical compatability. There are available in supply houses tables of compatibility upon which such selections may reliably be made.

Figure 5B:
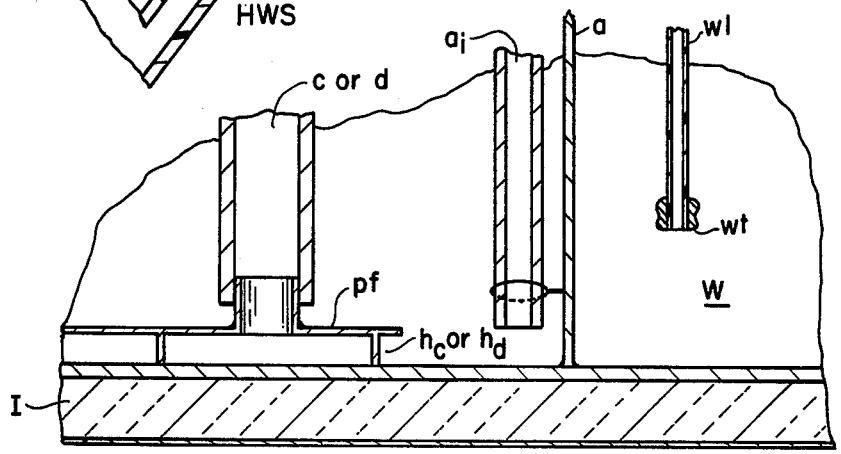

FIG. 5*b* shows sketches of the lower sections of either lines *d* or *c* (They differ only in size), the air inlet $a_i$, and the water line w1 at the bottom of the hot liquids tank. At these FL and OL inlet positions the lines *c* and *d* must be accurately positioned a fixed distance off the bottom of the tank (depending on the flow rate and conduit diameter) in order to permit unobstructed flow and at the same time accurately control the effective pressure driving the flow. Otherwise these lines will bobble up and down causing variable pressure drive (even though the air-pressure gauge will not show it) by reason of the variable effective fluid "head" thus produced. To accomplish this, the ends of these FL and OL lines were connected to platform *pf* by means of a friction-fitted tube through platform *pf* and positioned off the floor of the tank by legs $h_c$ (or $h_d$) ½ to 3 inches in length. The air inlet line was likewise fixed in a position near the corresponding inlet line. No platform need, of course, be supplied for the water line, but a weight *wt* is connected to it to keep it near the bottom, as illustrated in the right-hand water compartment separated from OL by the stainless steel partition *a*.

Figure 5C:
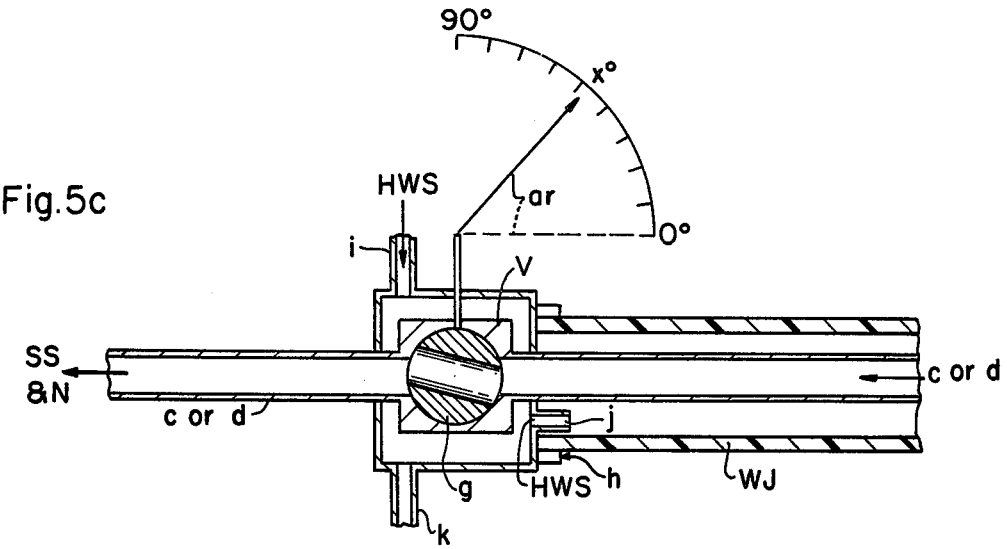

The hot liquids lines *c* and *d* need to be temperature controlled outside the hot liquids tank because careful and proper temperature control permits one to improve slurry sensitivity and the liquids might otherwise solidify in the flow lines *c* and *d*, particularly in cold weather. FIG. 5*c* illustrates a simple and effective system for such control. To ball valve V was welded a steel jacket provided with a water inlet *i* and the outlet *j* opened into the annulus between tube *c* (or *d*) and outer (water) house WJ. One outlet *k* of the jacketed ball valve provides the inlet for the other hot-water-jacketed ball valve as illustrated in FIG. 6. Inlet *i* was fed with hot water from the (thermostated) radiator of the compressor. The outlet (back to the radiator of the compressor) was in the other end of WJ at a point close to (but not in) safety valve SV of FIG. 5*a*. The latter valve need not be jacketed but instead it may be simply thermally insulated since it is used only infrequently. The ball *g* in ball valve V of FIG. 5*c* is shown at a particular opening other than full with the manual control arm *ar* pointing to position *x*° on the protractor. (In the closed position it would point to 0° whereas in the fully open position the arm *ar* points to 90°.) The hot-water jacket was clamped to a tube connected tightly to water-jacketed valve V on one end and the safety valve on the other.

Apparatus in Controls Cab

FIG. 6 sketches the design of the connections, the start-stop, valve controls, and other arrangements in the controls cab of the pump truck. Hot-water-jacketed flow lines *c* and *d* entered the controls cab beneath the prills bin $B_1$ through a safety panel between the control cab and the compressor compartment. The tubing between valves V and side arm N of mixing funnel $F_m$ was not hot-water jacketed in order to be able to operate the start-stop system.

Trace liquids were fed by air pressure through small transparent polyvinyl tubing from tanks $D_1$ and $D_2$ through rotometers $Vt_1$ and $Vt_2$, on across the start-stop block SSb and into arm N of the mixing funnel $F_m$. Flows may readily be controlled with required accuracy by rotometers, elaborate pressure-drive control not being needed either for these two liquids or the hot (wash) water.

It is desirable, though not absolutely necessary, to premix all liquids (FL, OL, the trace liquids flowing in lines *e* and *f*) before they come into contact with the cooling solid(s). Side arm N, a hole in the *c* line into which the *d* line flows (by inserting the latter in this hole) and in turn in the *d* line into which *e* and *f* lines flow by similar insertions at or near point L inside the arm N of funnel $F_m$ accomplish this with surprising efficiency.

Solids flow into $F_m$ through (calibrated, scaled) gate openings $G_1$ and $G_2$ at the bottoms of bins $B_1$ and $B_2$. Mixing is controlled primarily by the speed of the air-powered stirring motor S, and additional mixing occurs in pump SP and hose H. Slurry, of course, must flow out of funnel $F_m$ into holding funnel $F_h$ at the same average rate that it is removed from funnel $F_h$ *b6* (Wilden or other conventional slurry) pump SP. One of the main tasks of the operator is to make sure the level U of the slurry in funnel $F_h$ is neither too high nor too low. If it is too high, the slurry will become thicker and more tightly gelled than desirable before it is pumped into the borehole. On the other hand, if it is too low, the slurry will entrain air causing air stirring of the slurry in boreholes containing water. Indeed, the proper operation of the pump (by hand control of the air line driving the pump) is a necessary and important task of the operator. This operation could be automated, if desired, but it would be expensive to do so.

Air Pneumatics of the Pump Truck

All powering in the pump truck is accomplished by air using, in the example described herein, a rotary-screw, 125 CFM air compressor to pressurize the various operations: the automatic controls, the hot liquid lines *c* and *d*, the trace liquid lines *e* and *f*, hot water flow, the vibrators on the solids bins (to insure constant, uniform flow of the solids), the mixing stirrer, the slurry pump, the reel, and an air hose to blow out the slurry hose and perhaps also for cleaning purposes. FIG. 7 illustrates the pressuring arrangements for these separate operations. In FIG. 7, C is the compressor, F*t* a filter, PG denotes pressure gauges, E is the control panel, V designates valves, PR designates pressure regulators, CV refers to check valves, SP is the slurry pump, FL, OL, W, $D_1$ and $D_2$ represent the respective liquids or tank compartment to be pressurized, V*b* are vibrators, S the stirrer of the mixing funnel, R is the reel, and L is a lubricator.

The hot-liquids air-pressure drive is the most critical as regards pressure control because the rates of flow of the fuel liquid and oxidizer liquid (each governed by Poiseuille's law) change with any change that may occur in the driving pressure thus affecting the composition of the slurry. The effective driving pressure of these flows is determined by two pressures: the air pressure $p_a$ in the top of each of the respective compartments of the tank above the liquid, and the liquid (hydrostatic head) pressure $p_1$. It is important that the sum $p_a + p_1$ remain constant in each of the hot-liquid (FL and OL) tanks at all stages during pumping. However, $p_1$ varies directly as the density $p$ times the fluid height $h$ of the liquid FL or OL above the inlet of the hot fluid line. Therefore, the pressure gauge (reading the effective pressure that determines the fluid flow in lines *c* and *d*) must be based on the pressure existing at the outlet end of the air pressure line ($p_a + ph$) placed (and secured) at or near the same level as the inlet of line *c* or *d* in this (or each of these) tank(s). For this pressure to be the same for both liquids FL and OL, the levels of the outlet in each air line, and the levels of the inlet in each liquid flow line out the tank must all be the same. On the other hand, it is not actually necessary that these levels are all the same but only that any differences remain fixed relative to each of the others so that the relative pressure driving the flows in lines *c* and *d* will remain fixed at a given value irrespective of the adjustment of RV, i.e., the applied pressure. This is best done by fixing all four of these positions at close to, but not necessarily at exactly, the same depths off the bottom of the tank as illustrated in FIG. 5*b*. Then, as long as both drives go through a common regulator RV (as in FIG. 7), the pressures on gauges $PG_c$ and $PG_d$ will always read the same. (Two different gauges should still be used on the separate lines into the FL and OL compartments as an independent check against possible leaks or malfunctions.) The hot-water line and the two trace-liquids air lines may be on the same line from a common regulator RV or on separate lines with separate RV's and PG's, if desired. These latter liquid flows do not require the same degree of (reading and control) accuracy as for the *c* and *d* lines because readily adjustable, variable flows are required on lines *e* and *f* anyway to meet variable conditions such as differences in rheology and density required in pumping holes with different amounts of water and at different depths. This is readily achieved by hand-operated controls on each rotometer of lines *e* and *f*. (No special control is needed on the hot-water line.) Thus the pressuring is done on compartment W of the hot-liquids tank and on tanks $D_1$ and $D_2$ by introducing the air at the top of the tanks as illustrated, the liquid flow lines running to the bottom of each of these tanks.

Finally, all air-pressure lines were provided with check valves CV to prevent flow of liquids back into the air lines when pressures in these lines drop below those in the fluids tanks.

With the arrangements illustrated in FIG. 5*b*, one is assured that the ratio of the rates of flow in lines *c* and *d* will remain fixed even though the pressure may change by some means or other. This is an important factor in insuring product reliability in slurries of the type described in copending patent application, Ser. No. 726,300. In a typical example, for instance, OL was 65%, FL 15%, and prilled AN 20% of the slurry (exclusive of the two trace liquids). Support then that for one reason or another the pressure driving OL and FL flows were to increase by 20%. Then the composition of the slurry would change from 65/15/20 to about 67/15.5/17.5 (percentage ratios) and the OB would decrease about 0.8%. A 20% variation in pressure is greater than any which need occur in a normal operation, but the variation in composition thus produced is approximately a tolerable limit. This would not be the case, however, if variations in pressure of this magnitude were to occur between one hot liquid and the other. For instance, if the pressure driving line *d* were to accidentally go 20% higher than that driving line *d*, the FL would increase to about 17.5% and OB would decrease by about 3.5% which is outside tolerable limits. This emphasizes the importance of fixing the ratio of pressures driving the separate hot liquid flows even though the absolute pressure may change within certain tolerable limits.

Automatic Controls

With the tanks pressurized and the hoses in place to carry the liquid, simply opening the constrictions in the hoses at SSt/SSb will cause the flow. This can, of course, be accomplished manually, but a pneumatic-operated, open-shut or on-off system controlled with timers accomplishes this much more efficiently, easily, and accurately. All four liquid flows (FL, OL, the cross-linker, and the gasser liquids) can be turned off and on simultaneously. The two dry bins can automatically be opened to any size and shut by an air-piston control operated simultaneously with the start-stop of the liquids. The pneumatic system operating from the air compressor contains primarily timers, on-off buttons, pressure valves, and air cylinders. In addition to starting and stopping the flows, they can start and stop the bin vibrators and the mixing funnel stirrer.

FIG. 8 is a sketch of the control panel E showing the start button sb and emergency stop button es, timers $t_1$ which closes the solid fuel gate $G_2$, and $t_2$ for stopping all other flows. Indicator (pop-out) buttons $l_1$, $l_2$ . . . $l_5$ show whether or not each pressure line is on. These include the SS*t* piston ($l_1$), the pistons holding up gates $G_1$ and $G_2$ ($l_2$ and $t_3$), the stirrer ($l_4$), and the vibrators ($l_5$). Switches $s_1$, $s_2$ . . . $s_5$ are the $G_2$ omit, the SS*t* pinch omit, $G_1$ omit, the stirrer omit, and the vibrator omit switches, respectively.

The mechanism of operation of the automatic air-pressure control system is illustrated schematically in FIG. 9. All lines were small-diameter pressure tubing. On the left-hand side were three-way "toggle valves." A' drives a piston to open the liquids pinch-off system to start the flows; B' is the toggle valve from the pushbutton to start the system; C' is from an emergency stop button; D' opens gate $G_2$, E' opens gate $G_1$, F' is to omit gate $G_2$, G' is to omit gate $G_1$, H' is to open flow line *e*, J' is to open flow line *f*; K' operates the stirrer of the mixer; and M' is the supply line to panel E from the compressor through a filter and regulator. At N' is a four-way double-pilot valve, through a ¼ inch "port" into a cylinder for controlling the start of the liquid flows. It is open when air pressure flows through "or-elements" 1 and 2 controlled (for an emergency stop by a signal from B') through "flip-flop" F'F' and timer *s'* through P'. The cylinder on Q' operates gate $G_2$ on a separate timer *s'* through line Q' controlled by "not element" $N_1$ fed from or-element 4 but cut off when there is a signal from *s'*. Likewise $G_1$ of bin $B_1$ is controlled through R' and "not-element" $N_2$ with a signal from or-element 5 except when cut off by not-element $N_2$. The air motor (or stirrer) of the mixing funnel remains on as long as there is air pressure on line S' through a three-way pilot valve feeding a ½ inch port. The vibrators are automated through line T' by a pressure flow from K' through not-element $N_3$. Lines *e* and *f* are opened through lines U' and V' using a two-way pilot valve and ¼ inch port with signals from J' and K'.

Having regard for the foregoing disclosure, the following is claimed as the inventive and patentable embodiments thereof:

1. A pump truck for handling aqueous slurry blasting agents which is provided with a compressed air drive for all liquids and which is free from augers, electrical drives, ingredient flow drive motors, and hydraulic drives.

2. The truck of claim 1 provided with gravity flow means for all solid ingredients.

3. A pump truck for handling aqueous slurry blasting agents, which comprises a hot liquids tank partitioned to form at least two (or three) compartments to accommodate at least one hot oxidizer liquid and at least one hot fuel liquid (and possibly also hot water).

4. The truck of claim 3 provided in addition with at least one solid-ingredient container.

5. The truck of claim 3 provided in addition with a compressed air drive for said hot liquids.

6. The truck of claim 3 provided in addition with a mixing funnel and jacketed fuel and oxidizer liquids conduits thereto.

7. The truck of claim 3 wherein hot liquid flow lines exit near the top of said fuel and oxidizer liquid compartments of said hot liquids tank.

8. The truck of claim 3 wherein air, fuel and oxidizer inlets are provided near the bottom of the respective compartments of said hot liquids tank.

9. The truck of claim 3 provided in addition with at least two trace liquids tanks.

10. A truck of claim 3 in which the mixing funnel is provided with an upward-tilting side arm into which the fuel- and oxidizer-liquid lines and the trace-liquid lines are inserted, such that they all terminate within the side arm, and wherein the fuel-liquid line is provided with holes of appropriate size at a point within the side arm into which the terminal ends of the trace-liquid lines may be inserted, and a hole of appropriate size in the oxidizer-liquid line also within the side arm into which the terminus of the fuel-liquid line may be inserted so that all liquids are premixed before entering the mixing funnel and coming into contact with the cold solids, thereby effecting optimum sensitization by intimacy of mixing.

11. The truck of claim 3 wherein a gravity flow arrangement is provided from the solids bins into the mixing funnel, including adjustable scale-gate openings at the bottom of said solid bins and start-stop controls.

12. The truck of claim 3 wherein liquid controls are provided including start-stop devices by push button control and a turn-off technique.

13. The truck of claim 3 provided with air-operated pistons for controlling orifices for the solid ingredients.

14. The truck of claim 3 provided with an air-pressure control system for operating all the start-stop devices.

15. The truck of claim 3 provided with presettable timers for operating automatic controls for changing the flow rates of the ingredients.

16. The truck of claim 3 provided with an automatic air driven control of ingredient flow and for powering all operations.

17. The truck of claim 3 provided with an automatic control panel for all ingredient lines.

18. The truck of claim 3 wherein the oxidizer and fuel-liquids compartments have manholes at the top with Kamlok devices and shut off valves to relieve pressure.

19. The truck of claim 3 wherein the fuel and oxidizer liquids flow lines have fail-safety valves.

20. A pump truck for handling aqueous slurry blasting agents, comprising a compartmented hot liquids tank with at least two (or three if a water tank is included) compartments, a compressed air drive for said hot liquids, at least one solids container provided with gravity flow means, at least two trace liquid tanks, a mixing funnel connected through a side arm by jacketed conduits to said hot liquids compartments and with conduits to said trace liquid tanks, and an automatic control panel for all ingredient lines.

21. The truck of claim 3 provided with a hot-water supply by means of a compartment either within or outside the hot-fuel and oxidizer liquids tank for washing, circulating within the jackets of the fuel and oxidizer liquid lines to keep them hot, or both.

* * * * *